US006009945A

United States Patent [19]

Ricks

[11] Patent Number: 6,009,945

[45] **Date of Patent: *Jan. 4, 2000**

[54] OIL WELL TOOL

[75] Inventor: Thomas E. Ricks, Odessa, Tex.

[73] Assignee: T-Rex Technology, Inc., Odessa, Tex.

[ * ] Notice: This patent is subject to a terminal disclaimer.

[21] Appl. No.: 08/966,525

[22] Filed: Nov. 10, 1997

Related U.S. Application Data

[63] Continuation-in-part of application No. 08/803,512, Feb. 20, 1997, Pat. No. 5,893,415.

[51] Int. Cl.[7] ..... E21B 43/00

[52] U.S. Cl. ..... 166/242.3; 166/151

[58] Field of Search ..... 166/277, 313, 166/386, 129, 145, 148, 151, 183, 185, 186, 372, 242.3, 242.5

[56] References Cited

U.S. PATENT DOCUMENTS

| | | | |
|---|---|---|---|
| 1,139,745 | 5/1915 | Ames . | |
| 1,238,165 | 8/1917 | Lynn . | |
| 1,536,348 | 5/1925 | Mack . | |
| 2,804,147 | 8/1957 | Pistole et al. | 166/14 |
| 2,913,054 | 11/1959 | Falk | 166/224 |
| 3,625,288 | 12/1971 | Roeder | 166/314 |
| 4,335,786 | 6/1982 | Smith | 166/372 |
| 4,700,783 | 10/1987 | Baron | 166/372 |
| 4,834,176 | 5/1989 | Renfroe, Jr. | 166/142 |
| 4,844,156 | 7/1989 | Hesh | 166/263 |
| 4,844,166 | 7/1989 | Koster | 166/243 |
| 5,046,558 | 9/1991 | Koster | 166/243 |
| 5,390,737 | 2/1995 | Jacobi et al. | 166/184 |
| 5,404,945 | 4/1995 | Head et al. | 166/242.3 |
| 5,507,343 | 4/1996 | Carlton et al. | 166/277 |
| 5,562,161 | 10/1996 | Hisaw et al. | 166/372 |
| 5,893,415 | 4/1999 | Ricks | 166/277 |

*Primary Examiner*—William Neuder
*Attorney, Agent, or Firm*—Jacobson, Price, Holman & Stern, PLLC

[57] ABSTRACT

An oil well tool for installation in a production tubing string to provide valved gas communication between the interior of the tubing string and the annulus between the tubing string and casing for improving production from the well. The tool includes a thick walled tubular body for in-line threaded connection in a tubing string and includes valved passageways for the automatic transfer of gas from the annulus into the interior of the tubing string when the pressure in the annulus exceeds the pressure in the tubing string by a designed differential. The tool can be installed in the well in various arrangements for improving production of the well.

18 Claims, 7 Drawing Sheets

OIL WELL TOOL

CROSS REFERENCE TO RELATED APPLICATIONS

This application is a continuation-in-part of copending U.S. application Ser. No. 08/803,512, filed Feb. 20, 1997 now U.S. Pat. No. 5,893,415 entitled GAS DIVERSION TOOL.

BACKGROUND OF THE INVENTION

1. Field of the Invention

This invention relates to a multiple function oil well tool for installation in a production tubing string to provide valved communication between the interior of the tubing string and the annulus between the exterior of the tubing string and the interior of the well casing. More specifically, the invention relates to a tubular body, similar to a collar, serially connected in a well tubing string, and includes valved passageways for the passage of gas from the annulus between the well casing and the exterior of the tubing string into the interior of the tubing string for movement of the gas along with the oil being produced up the tubing string to the well head at ground surface.

In one function of the tool, it performs as a gas diversion tool to enable a well to be pumped with the tool being oriented below a packer to seal off a hole, crack or other leak in the casing. In another function of the tool, the efficiency of the down hole rod pump can be improved by introducing gas above the pump to cause a gas lift effect on the fluid being pumped and enable the pump to operate at higher pump capacity. In a further function of the tool, it is placed above the packer and a gas compressor at ground surface injects gas down the annulus between the tubing string and the casing with the pressurized gas entering the tool through the valved passageways to lift the fluid out of the well to produce a gas lift effect. A still further function of the tool is use as a pump assist tool in which the tool is installed in the tubing string above the pump to assist the pump by eliminating gas locking of the pump thereby lightening the load on the pump, pump rods and pump jack.

2. Description of Related Art

With regard to the function of the tool as a gas diversion tool, it is well known that oil and gas wells with cracked casings present problems to economical removal of the oil and gas. Typically, the crack or hole in the casing permits contaminating materials, such as water and mud, to enter the well and flood out the productive oil and gas zone, thereby rendering a marginal well uneconomical to pump the oil to the surface. The conventional solution is to repair the casing at the crack or hole by the "cement squeeze" process; however, this is very costly and is not economically feasible in marginal wells. Further, there is no assurance a "cement squeeze" repair will hold. Thus, there is a great demand for a simple and inexpensive tool which can be utilized in wells having a cracked or leaking casing, especially marginal wells, to make the wells productive.

The U.S. patent art includes various prior patents which disclose excess gas pressure diversion and venting structures as well as sealing and fluid bypass structures that pertain to improvements in well production. For example, Mack U.S. Pat. No. 1,536,348 discloses a gas venting tool disposed in a tubing string below a packer and capable of enabling the flow of gas from the exterior of the tubing string into the interior of the latter. However, the Mack gas venting tool is made as part of the packer and is designed to be used in conjunction with, and sealed relative to, the upper end of a "bottom casing". However, installation of the Mack device requires stabbing of the tool into the upper open end of a casing string and lowering the tool down onto the casing to create a seal.

Lynn U.S. Pat. No. 1,238,165 also discloses a gas venting tool, but the Lynn tool is interposed between two laterally offset tubing sections and therefore prevents the passage of various repair and/or service tools downwardly through the tubing string past the venting tool. Also, it would appear that the Lynn tool would not provide sufficient clearance for a pump rod. Carlton et al. U.S. Pat. No. 5,507,343 discloses an apparatus for repairing a damaged well casing and employs two packers with gas vents.

Ames U.S. Pat. No. 1,139,745 is directed toward an apparatus for evacuating gas from a closed well to permit the continuing flow of oil into the well casing. Roeder U.S. Pat. No. 3,625,288 discloses a pump assembly providing a plurality of passageways to accommodate oil, gas and power fluid flow as well as a structure for alternately using the various passageways. Jacobi U.S. Pat. No. 5,390,737 discloses a packer assembly with a sliding valve to be opened or closed manually, and Renfroe U.S. Pat. No. 4,834,176 discloses a device for opening a valve to communicate the exterior and interior of the tool. The patents to Pistole et al., U.S. Pat. No. 2,804,147, and to Koster, U.S. Pat. No. 5,046,558, disclose structures for sealing leaks in casings. Finally, Falk U.S. Pat. No. 2,913,054 discloses a device for closing a connection in the tubing string between different zones separated by a packer, and Hesh U.S. Pat. No. 4,844,156 discloses a method for promoting increased formation flow.

The above prior art does not disclose a simple and inexpensive tool that can be readily inserted into a tubing string below or above a packer, or without a packer, and that provides valved communication between the interior of the tubing string and the annulus between the casing and the exterior of the tubing string which will (1) divert gas buildup which occurs outside of the tubing string below a packer into the tubing string to flow to the surface along with the oil being pumped up the tubing string, (2) increase the effective pump capacity of the down hole pump, (3) function as a gas lift device when compressed gas is pumped down the annulus from ground surface by a compressor and the tool is placed above a packer, and (4) eliminate gas locking of the pump when the tool is installed above the pump to reduce the load on the pump, pump rod and pump jack.

SUMMARY OF THE INVENTION

To overcome the deficiencies of the prior art, the present invention when functioning as a gas diversion tool can be readily installed in an existing tubing string with a conventional tension packer positioned above the tool. The packer location places the packer and tool below a crack or hole in the casing when the system is completely installed. Once the tool and packer are in place, the packer is activated to seal off the casing below the crack and thereby prevent migration of the contaminating materials from the crack to the bottom of the well. The sealing of the casing also prohibits the upward flow of gases from below the packer and outside the tubing string to the surface. As the oil and gas enter the well, the oil falls to the bottom, where it can be pumped to the surface, and the gas flows upward. When there is a gas pressure buildup inside the casing, the tool automatically diverts this gas into the tubing string, where it can then flow to the surface along with the oil being pumped.

When the tool is used to increase the effective pump capacity of the down hole pump, the tool is installed in the same manner as described above, when it functions as a gas diversion tool. In this arrangement, the effective capacity of the down hole pump is increased. More specifically, a rod pump when obtained and installed in an operating mode, such as an oil well pump, is typically provided with a delivery capability when the pump is functioning at 100% efficiency. However, in practical use, due to the load on the pump, pump rod and pump jack, and due to gas locking, the maximum efficiency usually ranges between 70 and 80%, that is, the pump produces oil at the well head at about 70 to 80% of its capacity. By utilization of the tool of this invention to introduce the gas through the tool into the tubing string, the gas produces a gas lift effect on the fluid being produced up the tubing string. Accordingly, the reduction of the load and the gas lift effect enables the pump capacity to be increased to approximately 100%.

When the tool of the present invention functions as a gas lift tool, the tool is placed above the packer which is positioned just above the perforations. A gas compressor is used at ground surface and injects compressed gas down the annulus between the casing and the tubing string with the compressed gas passing inwardly through the tool into the interior of the tubing string to lift the production fluid or oil out of the well.

When the tool functions as a pump assist tool which prevents the pump from gas locking, the tool is installed in the tubing string above the pump without a packer. The cylindrical body or collar of the tool preferably has a larger diameter in order to cause the gas to more readily enter the tool and pass to the interior of the tubing string. This passage of the gas into the tubing string assists the pump by eliminating gas locking of the pump and also by lightening the load on the pump, rods and pump jack.

The oil well tool in accordance with the present invention has a simple thick walled cylindrical body, similar to a collar, with appropriate threads, top and bottom, for serial connection within a tubing string. The tool preferably includes a plurality of substantially vertical gas passageways having bottom inlets peripherally around the tool body. These passageways each lead to a check valve which permits the gas to enter the interior of the tool responsive to a specific differential in the pressure of the gas in the annulus between the outside of the tubing string and the inside of the casing above the pressure of fluid within the tubing string. The interior of the tool is generally in line with the interior of the tubing string so that the gas entering the interior of the tool can then pass up the tubing with the oil that is being pumped up the tubing to the surface. Further, this in line alignment of the interior of the tool with the interior of the tubing eliminates obstruction to the passage of various tools therethrough for performing repair or maintenance functions within an associated well below the tool.

The gas passageway inlets and check valves consist of a plurality of circumferentially spaced longitudinal bores in the thick wall of the cylindrical body with each bore being provided with an upwardly opening valve seat. The bores are preferably vertical and straight in the thick wall of the cylindrical body. A ball check valve and cylindrical hold down and wiper rod are movably received in each bore and the ball valve is engaged with the valve seat and the rod is engaged with the ball valve. The interior of the thick walled tubular body includes a circumferentially extending undercut portion opening slightly into the adjacent sides of the bores appreciably above the lower ends thereof. Hence, when the gas pressure outside the tool and inside the casing exceeds the fluid pressure within the tubing string by a predetermined amount, the gas pressure causes the ball check valves and cylindrical hold down and wiper rods to move upwardly to a point which permits the higher pressure gas to enter into the interior of the tool through openings in the sides of the bores. The gas then passes into the interior of the tool and passes upwardly through the interior of the tubing string along with the oil being produced. The combined weight of the ball check valve and wiper rod counters the pressure of the inlet gas until it reaches the design opening minimum pressure differential. In accordance with the present invention, it has been found that the design minimum pressure differential for initial opening of the check valves in accordance with the tool of the present invention should be about 2 psi and that full opening of the check valves should be at about 7 psi.

In accordance with the foregoing, an object of this invention is to provide an oil well tool serially connected within a tubing string through the use of threaded connections with the tubing string and which communicates the interior of the tubing string with the annulus between the exterior of the tubing string and the casing responsive to a predetermined differential in fluid pressure exteriorly of the tubing string over the fluid pressure interiorally the tubing string.

Another object of this invention is to provide an oil well tool which may be serially connected within a tubing string in a manner to enable all repair and maintenance tools moving downwardly through the tubing string to also pass easily through the tool.

A further object of this invention is to provide an oil well tool of simple construction, which includes inexpensive components and which may be manufactured by inexpensive manufacturing procedures.

Yet another object of this invention is to provide an oil well tool including check valve assemblies which are highly dependable in operation and offer a long life expectancy of operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
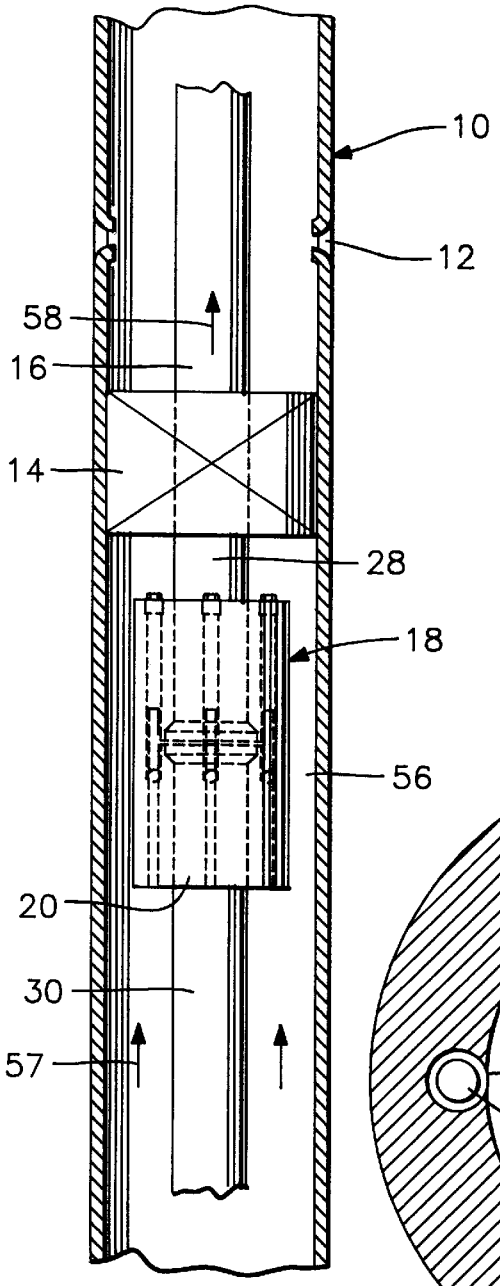
FIG. 1 is a fragmentary vertical sectional view of a well casing including a hole or leaking area in an upper portion, a packer installed between a tubing string and the casing with the oil well tool of this invention used as a gas diversion tool serially connected in the tubing string below the packer.
Figure 5:
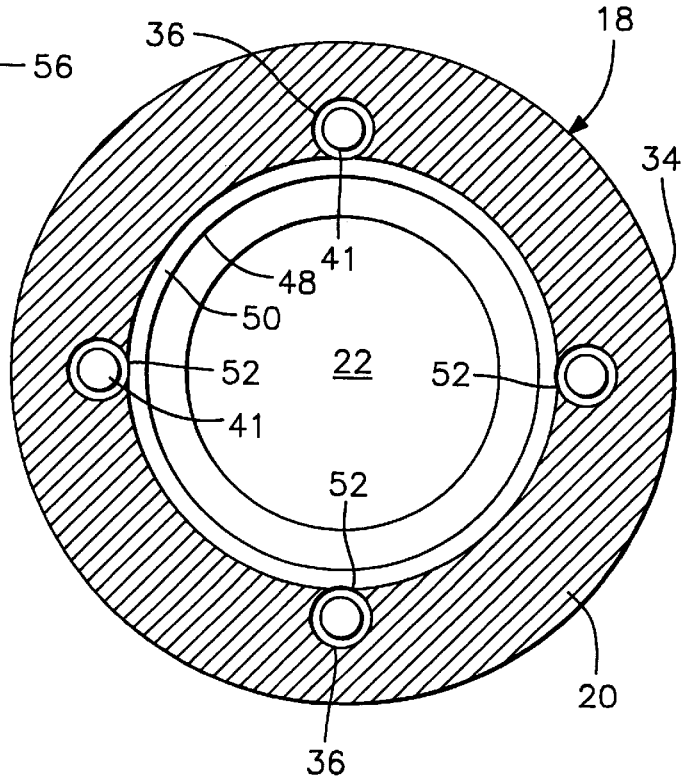
FIG. 5 is a transverse sectional view taken along section line 5—5 of FIG. 2.

In describing the preferred embodiments of the present invention as illustrated in the drawings, specific terminology will be resorted to for the sake of clarity. However, the invention is not intended to be limited to the specific embodiments illustrated and terms so selected; it being understood that each specific term includes all technical equivalents which operate in a similar manner to accomplish a similar purpose.

Referring now more specifically to FIGS. 1–5 of the drawings, numeral 10 generally designates an in ground well casing including a perforated or leaking area 12, such as caused by corrosive water or the like. The perforated area 12 allows water and mud to enter the casing and to fall downwardly to the bottom of the well contaminating the oil and gas entering the casing through the production zone or zones (not shown). The water and mud interfere with pumping the oil and gas to the surface and the static pressure of such water and mud at the production zone can actually completely stop oil flow from the production zone into the well casing.

When such a condition exists in a "marginal well", the well becomes unprofitable to pump and in many cases the well is so "marginal" that expensive repair of the perforated area 12 is not carried out and the well is shut down. Although it is possible to prevent the downward flow of the water and mud from the perforated area 12 to the bottom of the casing 10 through the utilization of a packer 14 connected in a tubing string 16 extending downwardly through the casing 10, see FIG. 1, in almost all cases the utilization of packer 14 within the casing 10 results in gas pressure within the casing 12 below the packer 14 being elevated to an extent that oil production into the lower end of the casing is either terminated or severely retarded, thereby also rendering oil production from the well uneconomical.

In order to restore or bring back such marginal wells into production, an oil well tool referred to generally by the reference numeral 18 and constructed in accordance with the present invention is serially connected within the tubing string 16 below the packer 14 to serve as a gas diversion tool. The tool 18 includes a thick walled cylindrical body 20, see FIG. 2, having a central longitudinal opening or passageway 22 defined therethrough. The opening 22 includes threaded upper and lower ends 24 and 26 at the top and bottom, respectively, thereof. In this manner, the tubing section 28 above the tool 18 may be threaded downwardly into the threaded upper end 24 of the central longitudinal opening 22, and the tubing section 30 disposed immediately below the tool 18 may have its upper end threaded into the threaded lower end 26 of the opening 22.

In addition to the central longitudinal opening or passageway 22, a series of preferably four longitudinal through bores 32 are formed through the body 20 at points spaced circumferentially thereabout generally intermediate the outer surface 34 of the body 20 and the inner surface 35 of the central longitudinal opening 22. The bores 32 include upper and diametrically enlarged counterbores 36 extending downwardly through generally two thirds the length of the body 20 and defining upwardly facing annular seats 38 at their lower ends. As shown, the through bores 32 and counterbores 36 are preferably straight and vertically aligned in the thick wall forming body 20.

A ball check valve 40 is downwardly received in each counterbore 36 and loosely seated against the corresponding seat 38. In addition, a cylindrical rod 41 which acts as a valve hold down and wiper is also positioned in each counterbore 36 and loosely seats downwardly upon the top of the corresponding ball check valve 40. Typically, the central longitudinal opening or passageway 22 may be about 2 ⅜ inches in diameter, the counterbores 36 about 7/16 inch in diameter, the rods 41 about 5/16 inch in diameter and the ball check valves 40 about ⅜ inch in diameter.

The upper ends of the counterbores 36 include threaded second counterbores 42 in which threaded plugs 44 are removably threaded to sealingly close the upper ends of the bores 32. Meanwhile, the lower ends of the bores 32 open downwardly through the lower axial end face 46 of the body 12 to provide inlets 47 for the gas into bores 32.

The approximate longitudinal mid-point of the rods 41 are aligned preferably with the longitudinal midpoint of the body 20 when the ball check valves 40 are seated and the rods 41 engage the valves 40. At approximately the longitudinal midpoint of the body 20, the body has a first undercut zone 48 of appreciable axial extent and a second undercut zone 50 of much shorter axial extent which opens into the adjacent sides of the counterbores 36. The opening of undercut zone 50 into the sides of counterbores 36 defines a short circumferentially extending slot 52 for each counterbore 36. Thus, when the tool includes four bores 32 and counterbores 36, there will be four slots 52. The slots 52 thus communicate the undercut zone 50 and the passageways 22 with the counterbores 36 in which the ball check valve 40 and cylindrical wipers 41 are loosely received.

Figure 2:
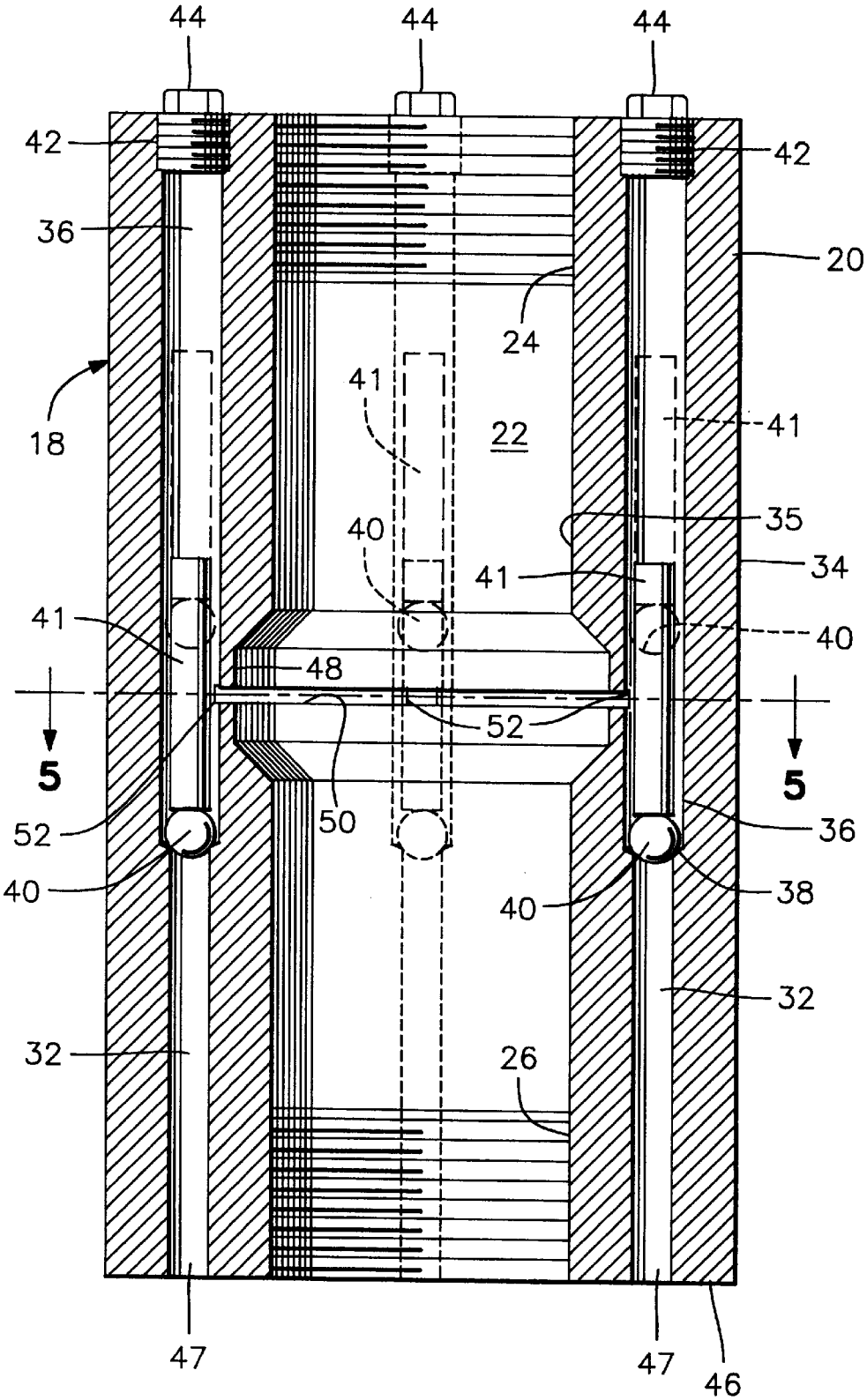
FIG. 2 is an enlarged longitudinal sectional view of the oil well tool of the present invention used as a gas diversion tool shown in FIG. 1.
Figure 3:
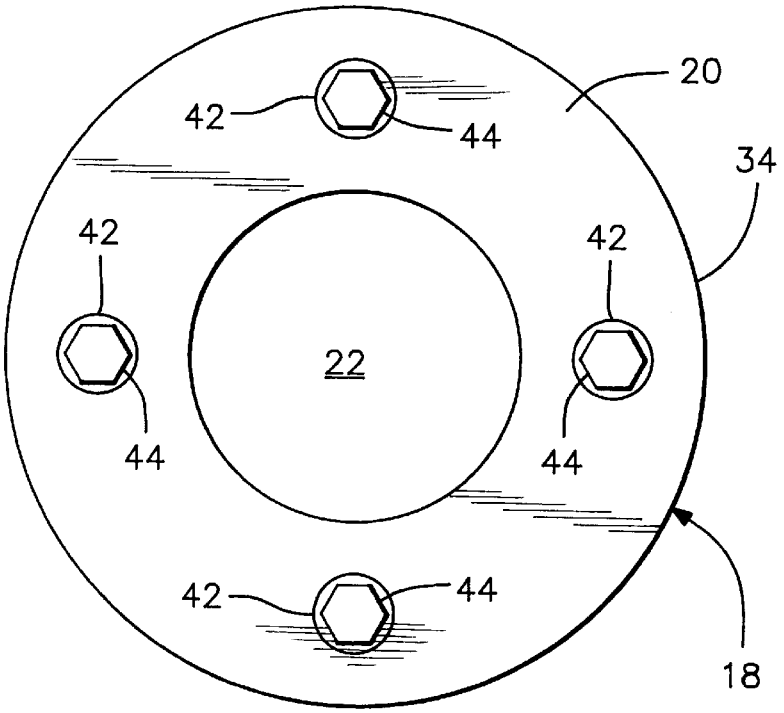
FIG. 3 is a top plan view of the tool illustrated in FIG. 2.
Figure 4:
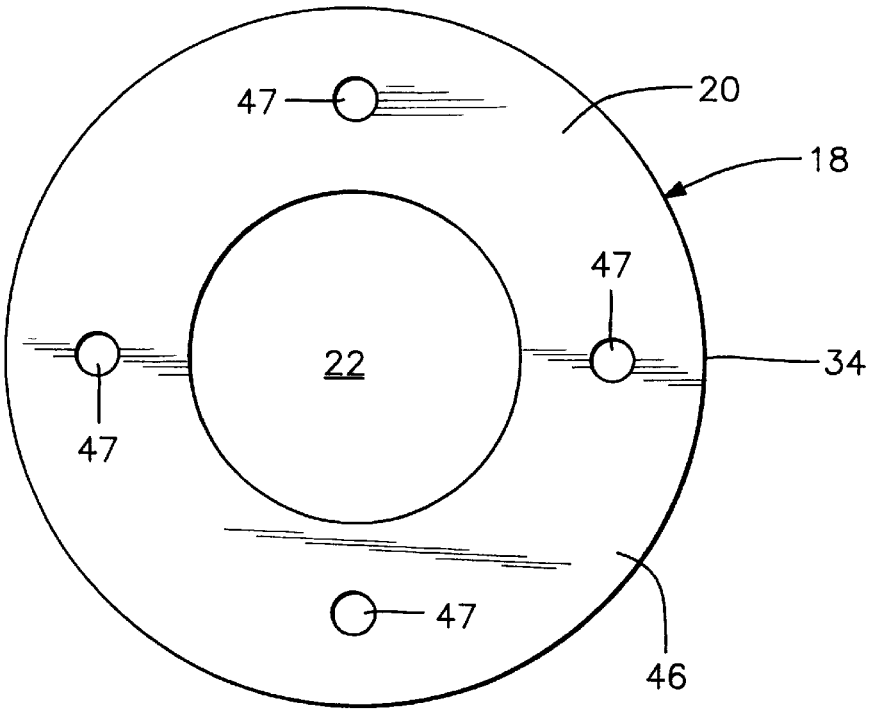
FIG. 4 is a bottom plan view of the tool illustrated in FIG. 2.

It will therefore be seen from FIGS. 1 and 2 that the inlets 47 at the lower ends of the bores 32, and the lower ends of the counterbores 36 and slots 50, define passageways communicating the annular zone 56 interiorly of the casing 10 and exteriorly of the tubing string 16 below the packer 14 with the interior of the tool 18 and its central longitudinal opening or passageway 22 and thence to the interior of the tubing string 16. Accordingly, if a gas pressure buildup occurs within the casing 10 below the packer 14 tending to restrict the flow of oil from the surrounding formation (not shown) into the bottom of the casing 10, as soon as that excess pressure reaches a level approximately 2 psi above the fluid pressure within the tubing string 16, the ball check valves 40 and wiper rods 41 are designed to move slightly upwardly within the counterbores 36. When the pressure differential of the gas on the exterior of the tubing string 16 to the fluid pressure within the tubing string reaches about 7 psi, the tool is designed so that the ball check valves 40 and wiper rods 41 have moved to the positions illustrated by the phantom lines in FIG. 2. However, different differential pressures may be utilized depending on the design details of the tool and the pressures encountered in the well. Hence, it is not intended that the present invention be limited to these preferred pressure differentials.

Once the gas starts to flow through the tool 18, the gas within the annular zone then moves upwardly in the general direction of the arrows 57, through the seats 38 and the slots 52 into the central longitudinal opening 22. From there, the gas flows upwardly through the central longitudinal opening 22 with the oil being pumped upwardly through the tubing string 16 from the bottom of the well, generally indicated by arrow 58. The gas is thus diverted by the tool of the present invention until the excess pressure in the casing has been relieved. Of course, once the excess gas pressure is relieved, the ball check valves 40 and wiper rods 41 return to the solid line positions illustrated in FIG. 2.

The longitudinally straight through bores 32 in the body 20, together with the counterbores 36 and the threaded second counterbores 42, may be formed through relatively easy and inexpensive machining procedures. Also, the undercut zones or portions 48 and 50 also may be inexpensively formed. Further, the tool 18 includes only the body 20, four ball valves 40 and four cylindrical rods 41 for the valve assemblies, and four plugs 44 to close the tops of counterbores 36. Hence, the entire tool 18 is very inexpensive to produce. In addition, the wiper rods 41 are provided to maintain the ball check valves 40 clean and the lower portions of the counterbores and the slots 52 free of accumulation of various materials which might otherwise tend to clog the gas pressure bypass passages. Still further, the central longitudinal opening 22 is preferably of a larger diameter than, and aligned with, the inside diameters of the tubing string sections. As such, the tool 18 does not present an obstruction to the passage therethrough of any well bottom repair, maintenance or other tools. Thus, a pump rod may easily pass and work through the central longitudinal opening 22.

The function of the oil well tool illustrated in FIGS. 1–5 as a gas diversion tool also increases the capacity of the down hole rod pump. Actually, the tool enables the pump to operate at or over 100% of rated pump capacity. When a down hole rod pump is obtained for positioning in a well, the supplier is typically provided with the size of the pump, the length of stroke and the number of strokes per minute. The supplier will then provide the pump and indicate the number of barrels of fluid the pump should deliver per minute at 100% efficiency. However, in practical operation, due to various loads, gas locking and the like, a pump usually functions at only 70 to 80% of its capacity. By utilizing the oil well tool 18 in the manner illustrated in FIGS. 1–5, the gas lifting effect and the reduction of the gas locking capability of the gas in relation to a down hole rod pump will enable all of these problems to be avoided so that the pump capacity will be increased substantially, to near or above its theoretical maximum.

Figure 6:
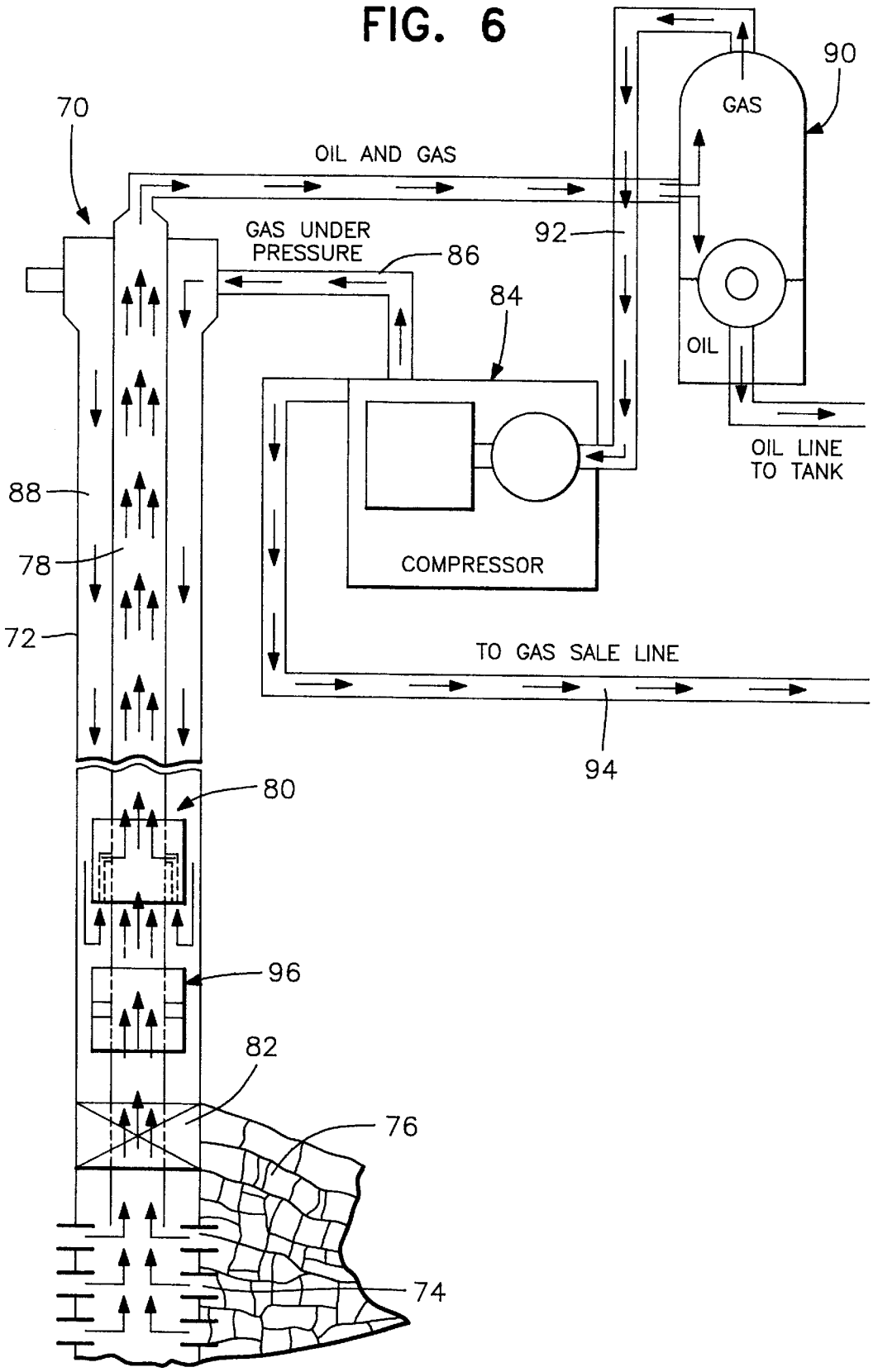
FIG. 6 is a schematic view of the oil well tool of the present invention functioning as a gas lift for the oil being pumped.

When the oil well tool of the present invention is utilized as a gas lift pump, the oil well tool can be installed in a system such as illustrated schematically in FIG. 6 of the drawings. The gas lift system is generally designated by reference numeral 70 and includes an oil well casing 72 having a perforated area 74 at the lower end thereof associated with an oil producing zone 76 which produces oil and gas for movement upwardly through a production tubing string 78. The oil well tool of this embodiment of the invention is generally designated by reference numeral 80 and can be the same structure as that disclosed in FIGS. 1–5. A packer 82 is positioned between the tubing string 78 and the casing 72 above the lower end of the tubing string and above the production zone so that all of the material produced from the formation 76 will pass upwardly through the pump production tubing string 78.

The gas lift system 70 includes a compressor assembly 84, preferably positioned above ground, which has a discharge line 86 extending into the annulus 88 between the casing 72 and the tubing string 78. The compressor 84 provides a supply of compressed gas which is discharged downwardly in the annulus 88 and is prevented from entering the formation of the production zone by packer 82. The pressurized gas is thus forced to enter the bottom of the oil well tool 80 in the same manner as in FIGS. 1–5 and thus enters into and mixes with the oil and other fluids being produced in the production tubing string. The introduction of the compressed gas into the tubing string 78 through the tool 80 causes the driving gas as well as the production fluids to move upwardly in the tubing string to the surface. When the mixture reaches the surface, it is direction into a separator, generally designated by numeral 90, in which the oil and gas are separated with the oil being discharged to a storage tank or the like and the gas being discharged back to the compressor 84 through a supply line 92. The gas passing into the compressor is cleaned or filtered and a portion of the gas may be discharged to a gas sale line 94. The remainder of the gas is then fed back into the annulus 88 for recirculation through the tool 80 so that the driving gas will continuously elevate the production fluids.

Since oil and gas wells have bottom hole pressure, the production fluid will enter the tubing string 78 and move up through the packer 82. The production fluid will mix with the gas that is being pressurized by the gas compressor 84 and continue the upward movement in the tubing string 78. This upward movement will create a vacuum or reduction in pressure on the formation and urge additional fluid into the lower end of tubing string 78 so that it can be brought to the surface.

By putting the oil well tool 80 above the packer 82 which itself is positioned just above the perforations 74, and with the gas compressor 84 injecting gas down into the casing and causing the compressed gas to go through the tool 80 and assist in lifting the fluids out of the well, the tool 80 acts as a gas lift pump. This arrangement of lifting the production fluid provides a very simple and highly efficient gas lift pump for producing fluid from a well. The gas lift pump method to produce the well in accordance with the present invention will eliminate the need of a mechanical pump whether it be a down hole rod pump or other type of pump and of course would also eliminate a pump jack and pump rods if a down hole rod pump has been replaced.

Figure 7:
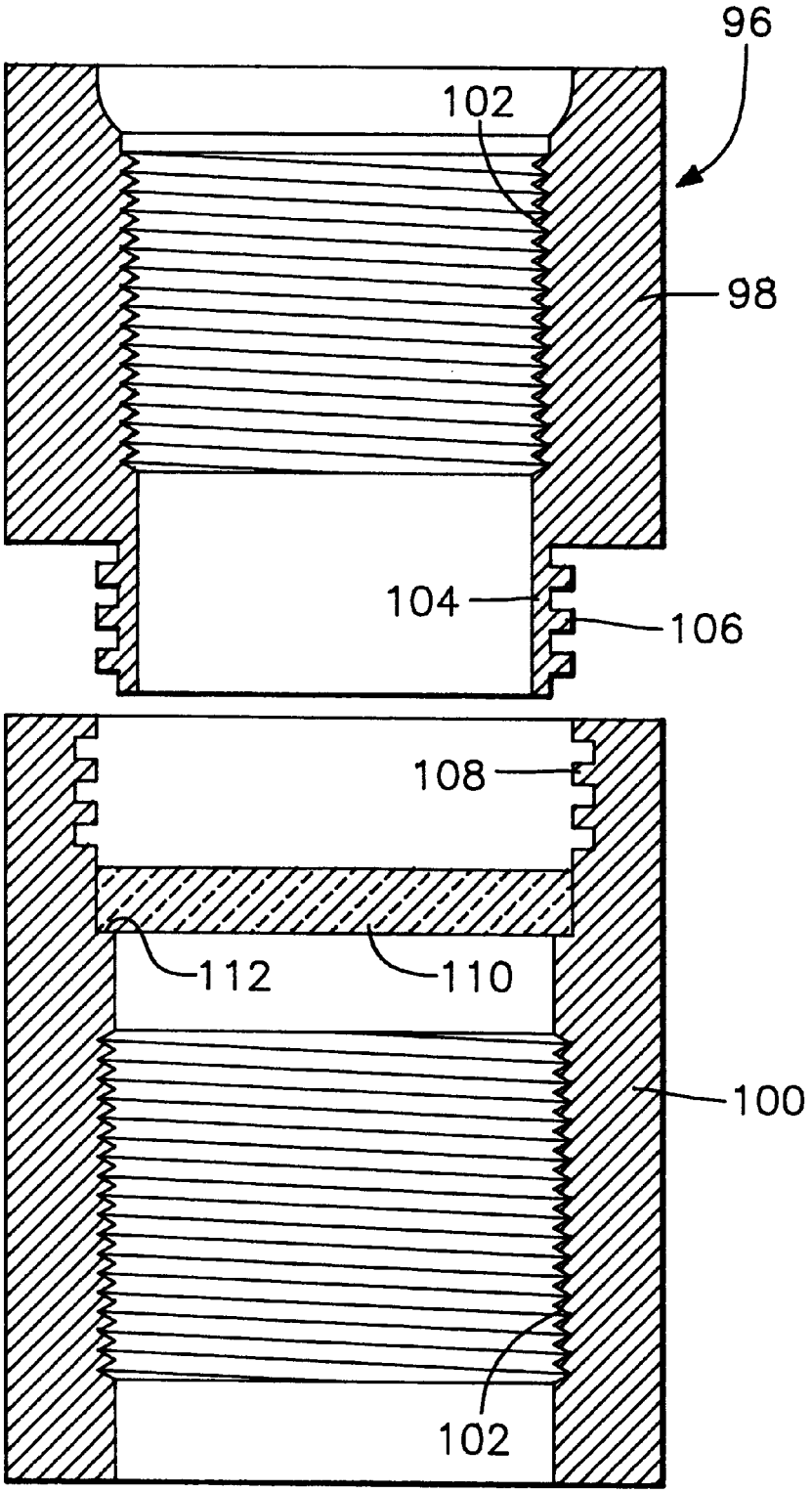
FIG. 7 is a sectional view of a tubing sub preferably positioned between the packer and the oil well tool of the present invention when functioning as a gas lift pump in order to prevent fluid and gas from entering the tubing string while the packer is being set.

Between the packer 82 and the tool 80, the tubing string 78 is preferably provided with a tubing sub generally designated by reference numeral 96 and illustrated in FIG. 7. Tubing sub 96 includes an upper component 98 and a lower component 100 which are each provided with internal screw threads 102 in order to connect the tubing sub into the tubing string. The upper component 98 is provided with an axially projecting lower end portion 104 that has a reduced external diameter and large external screw threads 106. Screw threads 106 interengage with a similar threaded interior area 108 of the lower component 100 which enables the tubing sub 98 to be made up with a ceramic disk 110 positioned on a shoulder 112 formed on the lower component 100. When the components are assembled, the threaded connections 106 and 108 will retain the ceramic disk 110 in place.

The tubing sub 96 is a tool used to keep fluid and gas from entering the tubing string until the packer 82 has been set. After the packer 82 has been set, the casing and the tubing can be swabbed dry by starting the gas compressor and having the gas move up the tubing string. Then a sinker bar (not shown) can be inserted into the tubing string 78 and lowered to break the ceramic disk 110 so that the fluid and gas from the formation can enter the tubing string and be pumped up the tubing string by the pressurized gas produced by the compressor. By using the oil well tool 80 as a gas lift pump together with the tubing sub 96 and packer 82, the production of oil from the formation can be pumped at a lesser cost initially and less energy since the gas lift pump will produce more production fluid with less cost than a comparable pump jack, sucker rod and down hole pump assembly.

Figure 8:
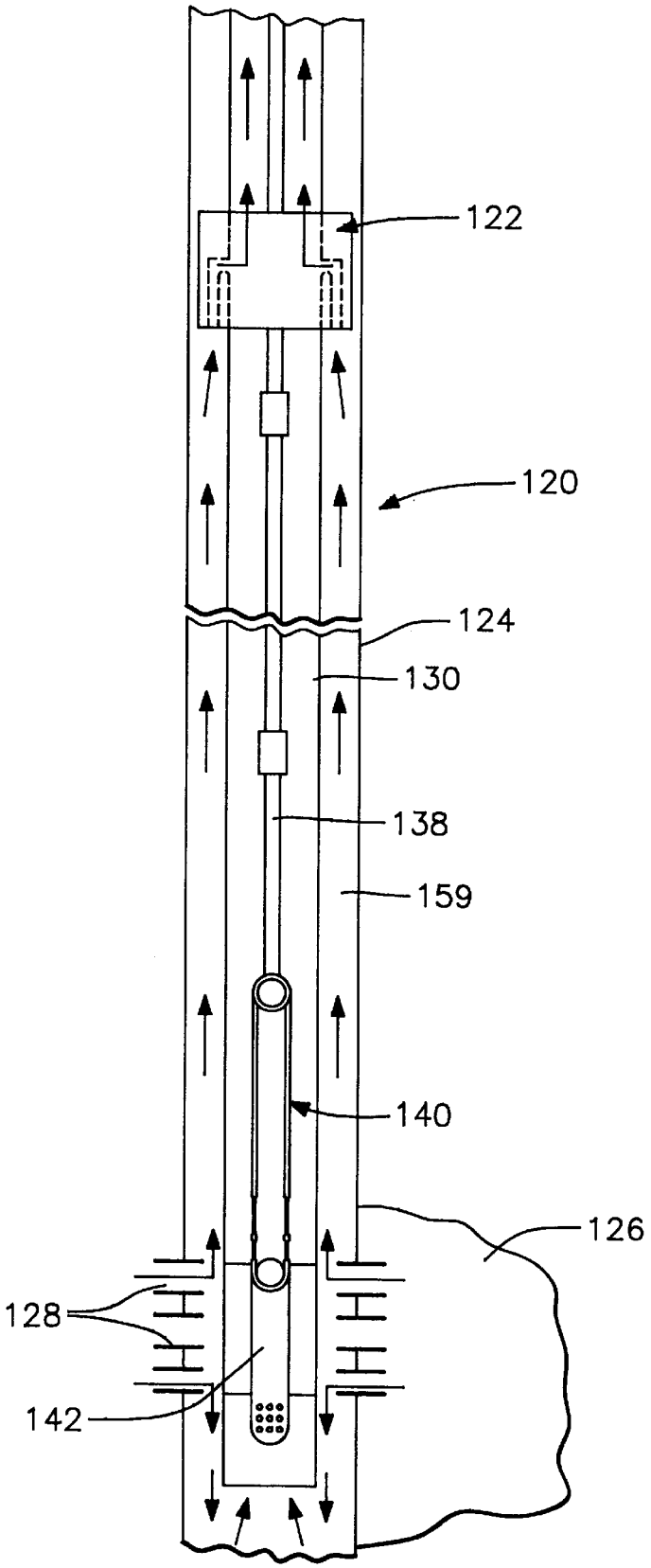
FIG. 8 is a schematic view of the oil well tool of the present invention functioning as a down hole pump assisting device to eliminate gas locking of the pump.
Figure 9:
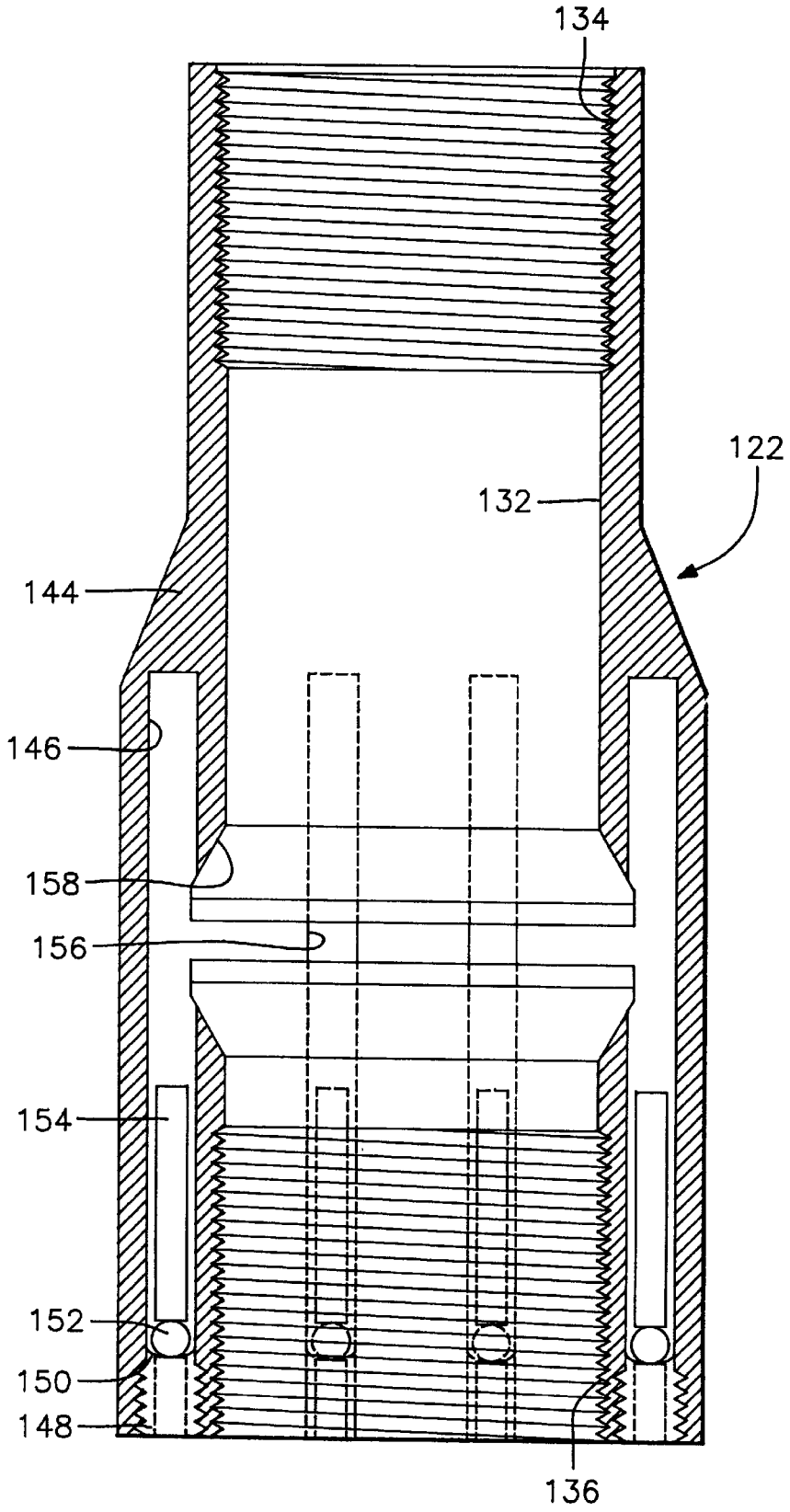
FIG. 9 is a longitudinal sectional view of a second embodiment of the oil well tool of the present invention functioning as the down hole pump assisting device illustrated in FIG. 8.

FIGS. 8 and 9 illustrate an embodiment of the oil well tool of the present invention in which the tool is used in the tubing string above a down hole rod pump to assist the pump in preventing gas locking. The oil well system is schematically illustrated in FIG. 8 and is generally designated by reference numeral 120. The system 120 includes the oil well tool 122 which is similar to but slightly different from that illustrated in FIGS. 2–5. In this construction, an oil well casing 124 extends into a production zone 126 which is communicated with the bottom of the casing through a perforated area 128. A tubing string 130 is made up with the tool 122 positioned therein. The tool 122 includes a generally vertical central open passageway 132 with a threaded upper end 134 and a threaded lower end 136 for make up with the tubing string. The tubing string 130 receives a pump rod or sucker rod 138 which extends through the passageway 132 in the tool 122. The pump rod 138 is operatively connected to a down hole rod pump, generally designated by reference numeral 140, which has a screened inlet 142. The upper end of the pump rod 138 is operatively connected to a pump jack (not shown) for reciprocating the rod and operating the down hole pump 140 in a conventional manner.

The tool 122 includes a thick walled body 144 similar to a collar and includes a plurality of longitudinal passageways 146 in the lower portion thereof. Preferably, eight generally cylindrical passageways are employed in this tool although the number may vary. The passageways are also preferably straight and aligned vertically in the tool 122. The lower end of each vertical passageway 146 is provided with a threaded insert 148 forming a valve seat 150 for a ball valve 152 having a wiper rod 154 extending vertically above the ball valve to retain the ball valve 152 in place on the seat and to keep the ball valve and passageways 146 clean during the vertical movement of the ball valve 152 upwardly. The central passageway 132 includes a circumferential undercut portion 158 located somewhere near the midpoint of vertical passageways 146 which forms circumferentially spaced slots 156 to communicate the vertical passageways 146 with the central passageway 132 through body 144.

Pressure buildup in the annulus 159 between the casing 124 and the tubing string 130 below the tool 122 will cause the ball valves 152 and wiper rods 154 to move upwardly away from valve seats 150. Upon upward vertical movement of ball valves 152, gas in annulus 159 is able to pass upwardly through the passageways 146, and then into central passageway 132 through circumferentially spaced slots 156, thereby communicating the annulus 159 with the tubing string 130 and introducing the gas pressure into the tubing string. As illustrated in FIG. 9, the transverse dimension of the body of the tool 122 adjacent its lower end is closer to the diameter of the casing 124 in order to provide a restriction in the annulus 159 so that the gas pressure from the formation will enter the tool 122 for assisting the pump by preventing gas locking of the pump. Introduction of the gas into the tubing string and the production oil passing upwardly therein will reduce the density of the production fluid and lighten the load on the down hole rod pump, the pump rods or sucker rods and the pump jack thereby enabling the pump to operate closer to maximum capacity.

The foregoing is considered as illustrative only of the principles of the invention. Further, since numerous modifications and changes will readily occur to those skilled in the art, it is not desired to limit the invention to the exact construction and operation shown and described. For example, while four or eight gas inlets and check valve assemblies are shown, more or less could be utilized. Further, the positioning of the inlets, the check valve assemblies and the passageways could be altered so long as the central longitudinal opening or passageway remains unobstructed and the check valve assemblies operate to transmit gas flow from the annulus between the tubing string and the casing to the interior of the tool and then up the tubing string. Accordingly, all suitable modifications and equivalents may be resorted to, falling within the scope of the invention.

What is claimed as new is as follows:

1. In combination, an upstanding well tubing string and an elongated tubular gas diverting tool threadedly connected in said well tubing string, said tool having a generally tubular body with a substantially central opening, said well tubing string and said tubular body defining a substantially coaxial longitudinal central passageway therethrough, said tubular body including at least one gas pressure relief passageway formed therein including an inlet end portion opening exteriorly of said tubular body and an outlet end opening into said central unobstructed longitudinal opening, and a check valve operatively associated with said gas pressure relief passageway closing said relief passageway against fluid flow therethrough and opening said gas pressure relief passageway to permit fluid flow therethrough responsive to a predetermined differential fluid pressure exteriorly of said tubular body over the fluid pressure within said tubular body central opening.

2. The combination of claim 1 wherein said body includes a plurality of said gas pressure relief passageways formed therein spaced about said body central opening and extending longitudinally of said body, said outlet ends opening downwardly from said body along the exterior of said tubing string.

3. The combination of claim 2 wherein said outlet end portions open generally laterally into said body central opening.

4. The combination of claim 1 wherein said body is thick walled and includes a plurality of through bores formed therethrough and circumferentially spaced about said body central opening, said through bores including upper end portion counterbores whose lower ends define upwardly facing annular seats, a plurality of ball check valves loosely received in said counterbores and seated on said seats and a plurality of elongated wipers loosely received and reciprocal in said counterbores above and downwardly seated against said ball valves, said body central opening including an interior circumferentially extending undercut portion opening into said counterbores generally intermediate upper and lower ends of said wipers, said counterbores having closed upper ends, said undercut portion, counterbores, and through bores defining said gas pressure relief passageway.

5. The combination of claim 4 wherein the upper ends of said counterbores include threaded second counterbores opening upwardly through the upper end of said body, and closure plugs removable threaded in said second counterbores.

6. In combination, an upstanding well tubing string and a gas diverting tool having an elongated tubular body connected lengthwise in said well tubing string, said body defining a central longitudinal passage therethrough at least generally concentric with said tubing string, said body including at least two peripherally spaced, longitudinally extending passageways formed therethrough and spaced about said central passage, said central passage including a diametrically enlarged undercut portion generally intermediate its opposite ends opening laterally into said passageways, said passageways including reduced diameter lower end portions spaced below said undercut portion and defining upwardly facing annular seats, and a plurality of ball valves loosely received in said passageways and gravity seated on said seats, the upper ends of said passageways being removably closed.

7. The combination of claim 6 wherein said passageways are four in number.

8. The combination of claim 6 wherein said passageways include threaded upper ends, and closure plugs removably threaded in said upper ends.

9. The combination of claim 6 including elongated rods loosely received lengthwise in said passageways including lower ends downwardly abutted against said ball valves and upper ends spaced above said undercut portion opening into said passageways.

10. The combination of claim 9 wherein said passageways include threaded upper ends, and closure plugs removably threaded in said upper ends.

11. An oil well tool made up into a production tubing string positioned in a well casing with an annulus between the tubing string and well casing, said tool comprising a tubular body having a passageway extending therethrough forming a continuation of the tubing string for upward movement of production fluid from a production zone of a well to ground surface, said body including at least one gas passage communicating the passageway through the body with the annulus between the tubing string and casing to enable gas to pass from the annulus to the passageway through the body for upward movement in the tubing string with the production fluid, said gas passage including a gravity operated valve assembly moved between open and closed positions in response to pressure differential between the annulus and the passageway through the body.

12. The oil well tool as defined in claim 11 wherein said valve assembly includes an upwardly opening valve seat, a ball check valve movably seated on said valve seat and an upwardly extending valve hold down and wiper rod in said gas passage in engagement with said ball valve to prevent clogging of the valve assembly and gas passageway.

13. The oil well tool as defined in claim 11 wherein said annulus is communicated with a source of pressurized gas located above the tool, a packer is positioned between the tubing string and the casing below the tool, and said gas passage enables pressurized gas in the annulus to pass into and combine with the production fluid in the tubing string for gas lift upward movement of the fluid to a well head.

14. The oil well tool as defined in claim 13 wherein said source of pressurized gas includes a compressor having a discharge communicating with an upper end of the annulus.

15. The oil well tool as defined in claim 13 wherein said tubing string includes a tubing sub located between said tubular body and said packer, said tubing sub including a passageway therethrough for upward movement of production fluid, said tubing sub including a rupturable barrier in said passageway to prevent movement of producing fluid upwardly above the tubing sub until said packer has been set and the production tubing swabbed after which the barrier can be ruptured to enable upward movement of production fluid upwardly in the production string above said sub.

16. The oil well tool as defined in claim 11 wherein said tool is located in a tubing string above a downhole pump, said gas passage enabling gas pressure buildup in the annulus to the interior of the tubing string to assist the pump by preventing gas locking of the pump.

17. The oil well tool as defined in claim 16 wherein said downhole pump is a rod pump, said introduction of gas into the production fluid reducing the density of the production fluid thereby reducing the load on the pump rods operating the pump and a pump jack thereby enabling the rod pump to operate more efficiently.

18. The oil well tool as defined in claim 11 wherein a packer is positioned between the tubing string and the casing above the tool and below a crack or leak in said casing, and said gas passage enables pressurized gas in the annulus to be diverted into said tubing string for relieving pressure buildup in said annulus.

* * * * *